US006760987B1

(12) United States Patent
Mulkey

(10) Patent No.: US 6,760,987 B1
(45) Date of Patent: Jul. 13, 2004

(54) ATTACHABLE AND VARIABLE NUMERIC CHARACTER

(76) Inventor: Lynn Mulkey, 5229 Brandonway Ct., Dublin, OH (US) 43017

( * ) Notice: Subject to any disclaimer, the term of this patent is extended or adjusted under 35 U.S.C. 154(b) by 0 days.

(21) Appl. No.: 09/993,106

(22) Filed: Nov. 6, 2001

(51) Int. Cl.[7] ..... B09F 9/30
(52) U.S. Cl. ..... 40/450; 40/594; 40/595
(58) Field of Search ..... 40/450, 594, 595

(56) References Cited

U.S. PATENT DOCUMENTS

| | | | | | |
|---|---|---|---|---|---|
| 3,315,387 | A | * | 4/1967 | Heuser | 40/595 |
| 3,733,468 | A | * | 5/1973 | Eberly, Jr. | 40/450 |
| 4,507,888 | A | * | 4/1985 | Robinson et al. | 40/621 |
| 4,672,759 | A | * | 6/1987 | Docherty et al. | 40/450 |
| 4,759,982 | A | | 7/1988 | Jenssen et al. | |
| 5,249,382 | A | * | 10/1993 | Moynihan | 40/630 |
| 5,521,578 | A | | 5/1996 | Del Valle | |
| 5,556,686 | A | | 9/1996 | O'Shea | |
| 5,621,993 | A | * | 4/1997 | Stover | 40/638 |
| 6,212,807 | B1 | | 4/2001 | Wright | |
| 2002/0166271 | A1 | * | 11/2002 | Johnston | 40/450 |

FOREIGN PATENT DOCUMENTS

| | | | | | |
|---|---|---|---|---|---|
| DE | 2824368 | A | * | 6/1979 | G09F/9/30 |
| GB | 1462307 | A | * | 1/1977 | G09D/3/12 |
| GB | 2002160 | A | * | 2/1979 | G09F/9/32 |

* cited by examiner

*Primary Examiner*—Cassandra H. Davis
(74) *Attorney, Agent, or Firm*—Standley Law Group LLP

(57) ABSTRACT

A variable numeric character from which any individual numeral from zero to nine may be formed. The variable numeric character is preferably a substantially hollow rectangular figure having both a horizontal and vertical bisecting leg. Individual segments of the legs forming the variable numeric character may be removed to form individual numerals. A plurality of individual variable numeric characters may be used to produce the individual numerals of a multi-digit number, such as on a sign. Each variable numeric character may be disposed between a removable backing sheet and removable covering sheet, and may possess an adhesive or magnetic mounting surface. The vertical bisecting leg of the variable numeric character allows for the creation of a numeral one that will exhibit proper spacing and alignment when used in a multi-digit number—without requiring that the numeral one be deliberately offset or otherwise located differently than the other numerals.

20 Claims, 6 Drawing Sheets

(KNOWN ART)

(KNOWN ART)

(KNOWN ART)

(KNOWN ART)

(KNOWN ART)

(KNOWN ART)

(SECTION B-B)

ATTACHABLE AND VARIABLE NUMERIC CHARACTER

BACKGROUND AND SUMMARY OF THE INVENTION

The present invention relates to a variable numeric character that can be affixed to a plurality of different surfaces, such as by means of an adhesive or magnetic backing, or through the use of various secondary fasteners. Any number from 0–9 may be created from a single numeric character of the present invention. Unlike known characters of similar design, the numeric character of the present invention allows for proper centering, or alignment, when a numeral "1" used in a multi-digit number.

Attachable and variable numeric characters have many uses. Such numeric characters may be used, for example, to indicate the address of residential or business locations. Such characters may also be used to construct signs for a multitude of purposes, such as, for example, signs used in stores or other establishments to indicate the price of goods. Of course, the above uses are merely exemplary, and the uses for such numeric characters is obviously not so limited.

It is possible, of course, to produce numeric characters corresponding to each of the individual numerals 0–9. In this manner, the desired individual numeral may be selected for use. Similarly, multiple individual characters can be used to create multi-digit numbers. There are, however, drawbacks to such a system. For example, if a customer places an order for a particular number of one or more particular numerals, the order must be filled precisely, or the customer will not be able to produce the desired display of individual numerals or strings of numerals. Also, there is the occasion where one or more particular numerals may not be available at the time of the order, or at the time of desired purchase in a store. It is not uncommon for the demand for certain numerical characters to exceed the demand for other numerical characters. This phenomenon may be attributable to a number of causes, most commonly the fact that certain numerical characters appear in street addresses and product prices more frequently than do others. Thus, if just one numerical character is unavailable, the desired numerical display cannot be created.

To alleviate this problem, variable numeric characters have been developed from which any number from 0–9 may be produced. Thus, it is not necessary to select or supply a particular number of a certain numeric character or characters. Any number or string of numbers may be created from a series of like variable numeric characters. Consequently, as long as there is an adequate quantity of variable numeric characters available, the desired numeric display can be created.

Such variable numeric characters typically take the form of a digit eight. More specifically, the characters generally take the shape of a vertically oriented rectangle formed from pairs of parallel horizontal and vertical legs. The rectangle is bisected by a horizontally disposed leg that also divides each vertical leg into two parts of substantially equal length. Thus, there is typically a total of 7 individual legs that form the digit eight. The digit eight is adapted so that each of the legs can be individually removed. This may be accomplished in several ways: typically by cutting away the desired portions with scissors or a knife; or by dividing the digit eight into pre-cut sections that can be peeled away. By either method, any number from 0–9 may be created from the digit eight by selectively removing certain of the individual sections or legs. Non-attachable digit eight numerals are commonly employed in LCD displays, such as on calculators, watches, and other devices.

These digit eight numeric characters are commonly provided with an adhesive or magnetic backing so that they may be applied to a variety of different surfaces. In certain applications, the desired individual sections or legs of the digit eight character may be removed prior to application. In other applications, the entire digit eight character may be applied to a surface, and the desired individual sections or legs thereof may thereafter be removed. The adhesive or magnetic-backed digit eight character is typically disposed between two sheets of other materials. Commonly, the digit eight character will have a paper or similar backing material that contacts the back surface thereof. The back side of the digit eight character is provided with an adhesive or magnetic material that allows it to be affixed to a surface. The front surface of the digit eight character is typically provided with a covering material that releasably clings to the digit eight character. Preferably, the bond between the covering material and the digit eight character is weaker than the bond that will be formed between the adhesive or magnetic material and the surface to which the numeral formed from the digit eight character will be applied. The surface of the backing material may be constructed from or coated with various substances that allow it to releasably adhere thereto, so that the backing material may be pulled away from the digit eight character without dislodging the individual sections thereof from the covering material.

Application of the digit eight character may be accomplished in several ways. When using digit eight characters that must be cut, the cuts are typically made before the backing material is removed. Once the desired numeral is produced therefrom, the backing material is removed, and the covering material may be used to apply the numeral to the desired surface. It is also possible, but more difficult, to remove the backing material prior to cutting the digit eight character to form the desired numeral. In one method of using a pre-cut digit eight character, the backing material is removed from the whole thereof, and the entire digit eight character is placed on the desired surface. The necessary individual sections may then be peeled or scraped away from the mounting surface to form the desired numeral. Alternatively, the backing material may be removed from the digit eight character, and the necessary individual sections thereof may be removed prior to application thereof to a mounting surface. In either case, the covering material is generally used to place the numeral into position and ensure proper adherence to the mounting surface. Using either the uncut or pre-cut digit eight character, once the resulting numeral has been properly adhered to the mounting surface, the covering material may be peeled away.

The digit eight characters and accompanying backing and covering materials are typically cut such that they are uniform in size. For example, the backing and covering materials commonly form a rectangle that is slightly larger than the digit eight character itself. The uniform size and shape of the digit eight character makes it easy to align the created numerals when making multi-digit numbers. However, a problem arises when it is desired to create a multi-digit number, wherein one of the numerals therein is a numeral "1". Unlike the other numerals from 0–9, the numeral "1" must be formed from one of the two vertical legs of the digit eight character. When a multi-digit number is created, this results in the numeral "1" being off-center with respect to the other numerals between which it is located. The offset is especially apparent when a horizontally running multi-digit number is created. Alternatively, if it is desired to locate the numeral "1" so that it is centered with respect to the other numerals of the multi-digit number, the digit eight character from which the numeral "1" will be produced must be offset or caused to overlap one of the other numerals. Thus, it is difficult to align the digit eight character when it is desired to produce a numeral "1" that is properly located with respect to the other numerals that make up a multi-digit number. Effecting proper alignment of the numeral "1" also results in the overlap of the covering materials, and possibly portions of the adhesive or magnetic material backed digit eight character. Consequently, obtaining proper alignment of the numeral "1" can cause two or more of the digit eight characters to undesirably adhere to one another.

While this characteristic of known digit eight characters may not be overly bothersome to a one time user who may be affixing only a few numerals, there are other users whom may use a significantly larger number of such digit eight characters—and who may do so on a regular basis. As such, there is a need for an attachable and variable numeric character that is capable of producing any of the individual numerals 0–9, but that can also provide for the proper alignment of the numeral "1" in a multi-digit number. The present invention satisfies this need. The present invention consists substantially of a digit eight character with an additional leg that vertically bisects the digit eight character into two relatively equivalent parts. The variable numeric character of the present invention will, therefore, be referred to herein as a digit twelve character.

The digit twelve character of the present invention may be designed to require the removal of particular individual sections by cutting, such as with scissors or a knife. Preferably, however, the digit twelve character is pre-cut into individual sections, which may be peeled or scraped away to form the desired numeral. The back surface of the digit twelve character may be provided with an adhesive or magnetic material that allows it to be affixed to a desired mounting surface. Alternatively, a secondary fastening means, such as tacks, nails, screws, staples, glue, tape or other acceptable means, may be employed to affix the digit twelve characters of the present invention to a mounting surface. Preferably, the digit twelve character is disposed between two sheets of other materials. More specifically, there is preferably a backing sheet that contacts and covers the adhesive or magnetic material-covered back surface of the digit twelve character. There is also preferably a cover sheet that is releasably attached to the front surface of the digit twelve character. Other means of presenting the digit twelve character for installation are also possible, however.

As with the known digit eight characters described above, the digit twelve characters are preferably of substantially uniform size and shape so that they may be easily aligned when used to create multi-digit numbers on a mounting surface. Unlike the known digit eight characters, however, the digit twelve character of the present invention does not result in a numeral "1" that is off-center with respect to its neighboring numerals if all the digit twelve characters are equally spaced. Similarly, the digit twelve character of the present invention does not require that it be offset with respect to any other digit twelve characters that surround it in order to obtain proper alignment of a numeral "1". Thus, the digit twelve character of the present invention allows for the creation of properly aligned multi-digit numbers on a mounting surface, without requiring special installation procedures for any of the particular numerals that make up the multi-digit number.

BRIEF DESCRIPTION OF THE DRAWINGS

In addition to the novel features and advantages mentioned above, other objects and advantages of the present invention will be readily apparent from the following descriptions of the drawings and exemplary embodiments, wherein like reference numerals across the several views refer to identical or equivalent features, and wherein.

DETAILED DESCRIPTION OF THE EXEMPLARY EMBODIMENT(S)

The present invention comprises an attachable and variable numeric character in the form of a digit twelve. The digit twelve variable numeric character can be used to produce any individual numeral from 0–9, and can also be employed to create multi-digit numbers wherein all the individual numerals thereof will be properly aligned without any special treatment thereof.

Figure 1:
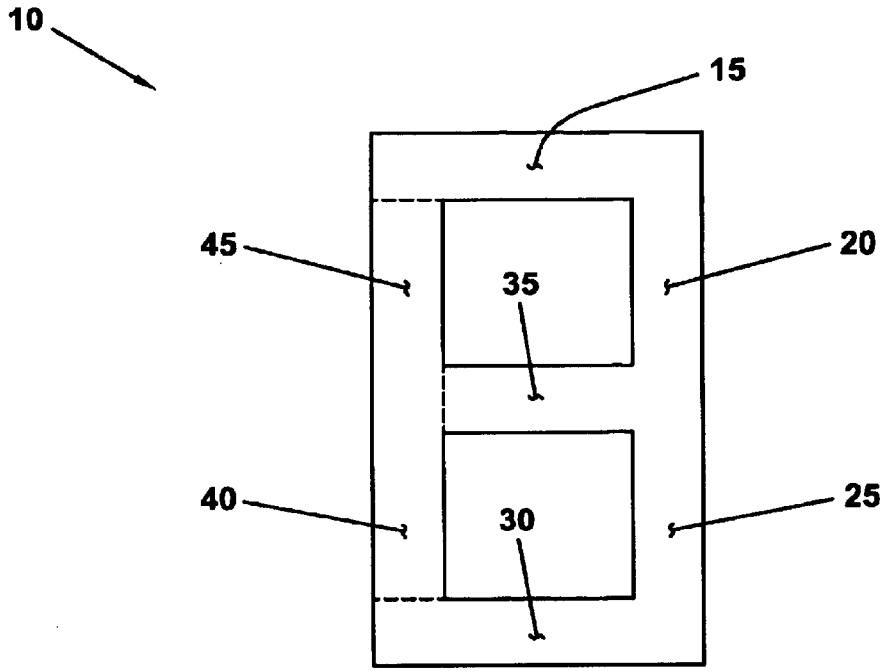
FIG. 1 depicts one embodiment of a known attachable and variable numeric character.

The deficiencies associated with creating multi-digit numbers from known attachable digit eight characters can be ascertained from FIGS. 1–4. Known attachable digit eight characters are provided in essentially two varieties. One type of attachable digit eight character is the cuttable digit eight character 10, as shown in FIG. 1. The cuttable digit eight character 10 requires that specific individual sections 15–45 be cut therefrom to form a particular numeral. For example, to form a numeral "3", sections 40 and 45 would be removed by cutting along the dotted lines. The sections 15–45 may be removed with scissors, a knife, or other suitable cutting means. Guide lines, such as the dotted lines shown, may be provided on the cuttable digit eight character 10 to assist in removing the necessary sections.

Figure 2:
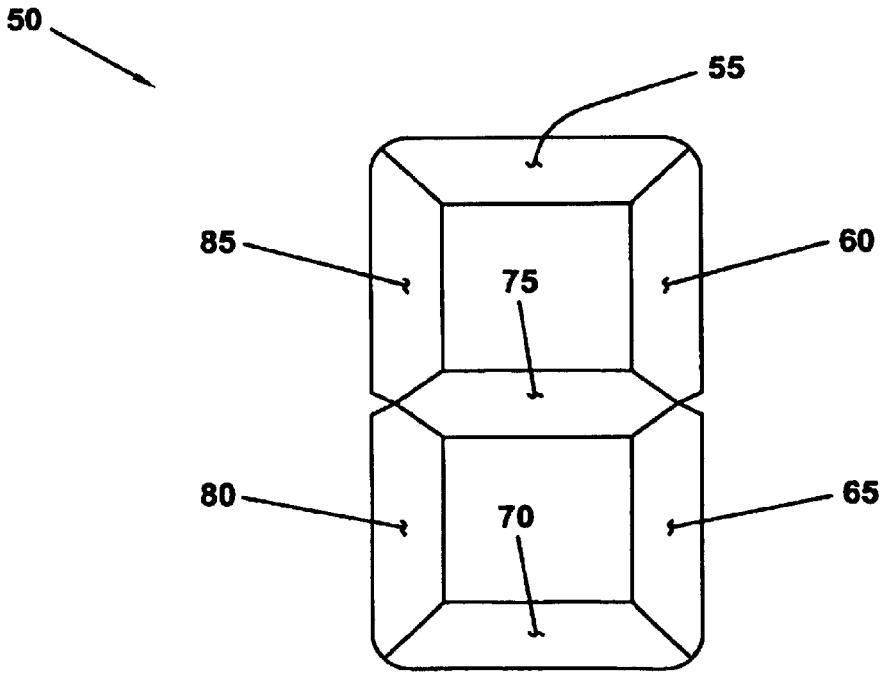
FIG. 2 illustrates an alternate embodiment of a known attachable and variable numeric character.

A second type of digit eight character is also known. As can be seen in FIG. 2, a pre-cut digit eight character 50 is available, wherein the digit eight character is pre-divided into individual sections. As in the cuttable digit eight character 10, specific individual sections 55–85 are removed from the pre-cut digit eight character 50 in order to form a particular numeral. For example, to create a numeral "4", individual sections 55, 70 and 80 are removed from the pre-cut digit eight character 50. In this type of digit eight character 50, the individual sections 55–85 may be removed by peeling them away from a covering material, or by scraping them from a mounting surface after affixation thereto.

When using either the cuttable digit eight character 10 or the pre-cut digit eight character 50, problems arise when it is desired to produce a multi-digit number that includes a numeral "1". As shown in FIGS. 3A–3B and 4A–4B, the design of both the cuttable digit eight character 10 and the pre-cut digit eight character 50 results in a misalignment of the numeral "1", unless special steps are taken to correct the problem. The misalignment will occur whether the multi-digit number is horizontally or vertically oriented.

Figure 3A:
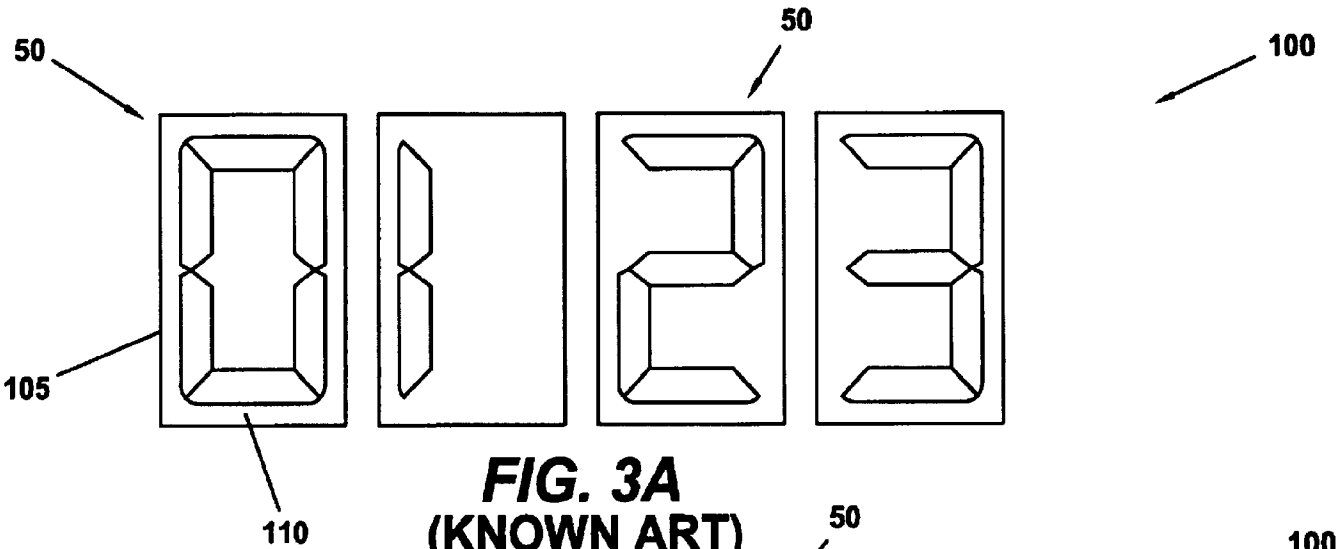
FIG. 3A shows a plurality of the attachable and variable numeric characters of FIG. 2 used to form a horizontally oriented multi-digit number, wherein it is illustrated how a numeral "1" produced from the variable numeric character will be improperly aligned.
Figure 3B:
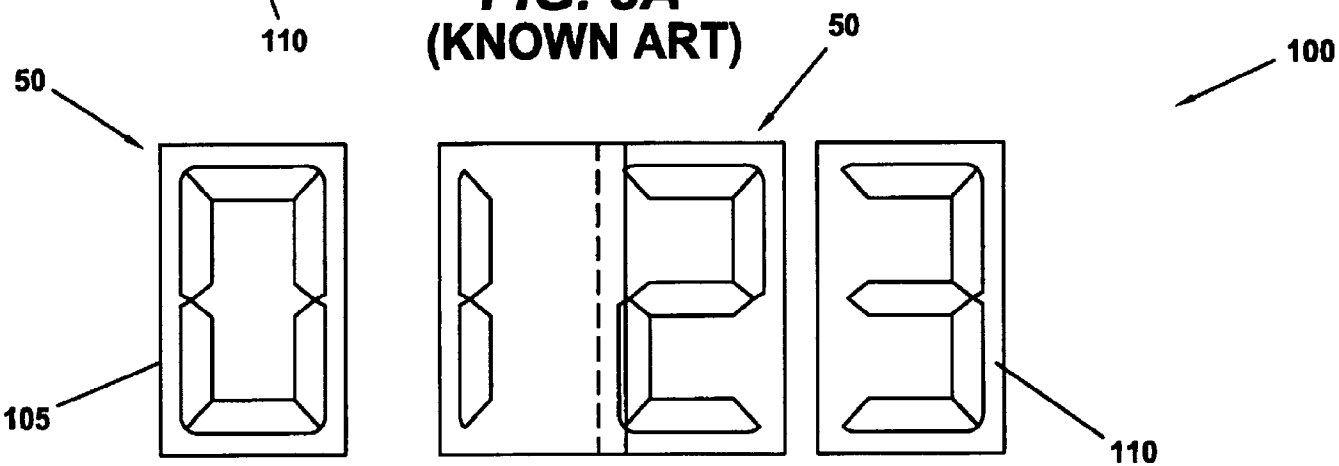
FIG. 3B shows a plurality of the attachable and variable numeric characters of FIG. 2 used to form a horizontally oriented multi-digit number, wherein it is illustrated how the variable numeric character used to create a numeral "1" must be offset to obtain proper alignment.

A horizontally oriented multi-digit number 100 created by employing a series of the pre-cut digit eight characters 50 can be seen by specific reference to FIGS. 3A and 3B. Although the multi-digit number 100 is shown in this example to be "0123", the problem associated with using the digit eight character will occur any time a numeral "1" is used in conjunction with other non-numeral "1" numerals. Attachable variable numeric characters are typically provided for use disposed between a backing sheet 105 and a covering sheet 110 (described in more detail below). Thus, each digit eight character 50 is of substantially uniform size and shape, such that alignment thereof is more easily accomplished. Consequently, when creating a multi-digit number from a series of the individual variable digit eight characters 50, the sides of each digit eight characters which are formed from the edges of the backing sheet 105 and cover sheet 110, may be abutted or otherwise spaced apart at substantially equal intervals. The result is typically a multi-digit number with equal spacing between each individual numeral thereof; in other words, all the numerals are aligned. However, if one of the individual numerals is a "1", equal spacing will not occur if the multi-digit number 100 is attached as described.

Referring specifically to FIG. 3A, it can be observed that providing for equal spacing between the individual numerals of a multi-digit number 100 that includes a numeral "1", results in a misalignment of the numeral "1" in relation to the individual numerals on either side thereof. In this particular example, while the spacing between the numeral "1" and the numeral "0" is proper, the spacing between the numeral "1" and the numeral "2" is too large. In order to produce a proper alignment of the numeral "1" with respect to the other individual numerals of the multi-digit number 100, it is necessary to shift the portion of the digit eight character 50 used to create the numeral "1". As shown in FIG. 3B, this may result in an overlap of one digit eight character 50 upon another. Such an overlap may result in the inadvertent adherence of one digit eight character 50 to the other, rather than an adherence to the mounting surface. Even if the individual digit eight characters 50 are separated by a sufficient gap so that no overlap occurs therebetween, obtaining proper spacing will require that the installer of the digit eight characters approximate the necessary position of the digit eight character used to create the numeral "1". As a result of these deficiencies, it is likely that a number of digit eight characters 50 may become adhered to one another, thus rendering them unusable, or that the resultant multi-digit number 100 will appear misaligned. As such digit eight characters 50 are commonly employed to create signs of other displays used to draw a viewer's attention, it is desirable that the aesthetic appearance thereof be as pleasing as possible. Consequently, misalignment is an undesirable characteristic.

Figure 4A:
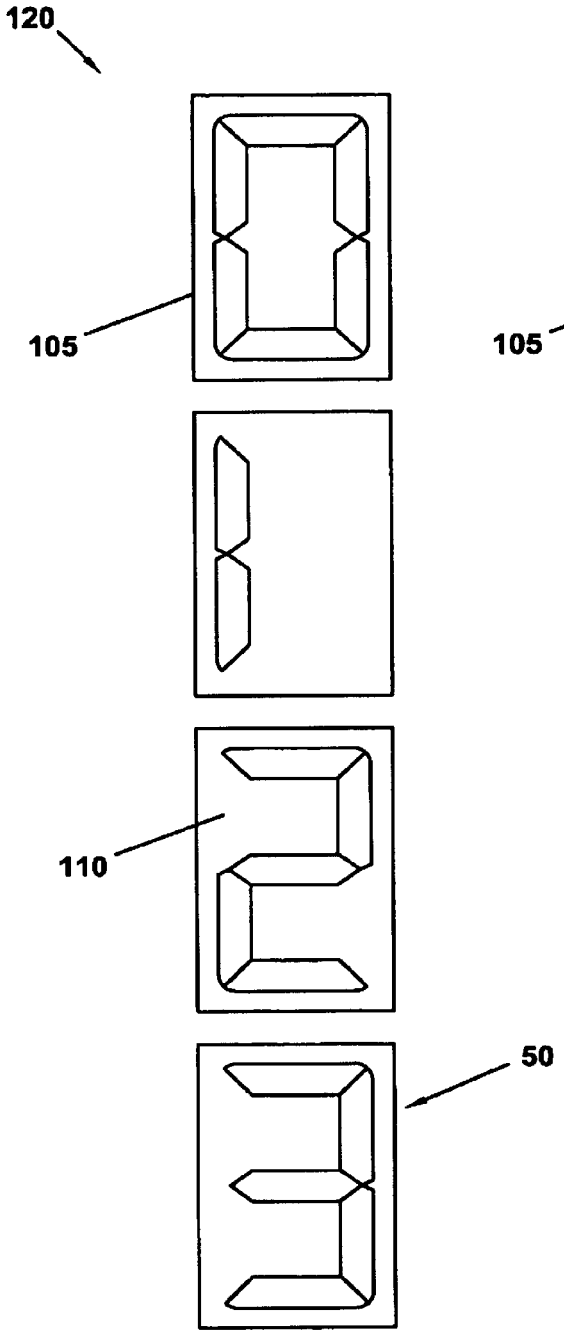
FIG. 4A shows a plurality of the attachable and variable numeric characters of FIG. 2 used to form a vertically oriented multi-digit number, wherein it is illustrated how a numeral "1" produced from the variable numeric character will be improperly aligned.
Figure 4B:
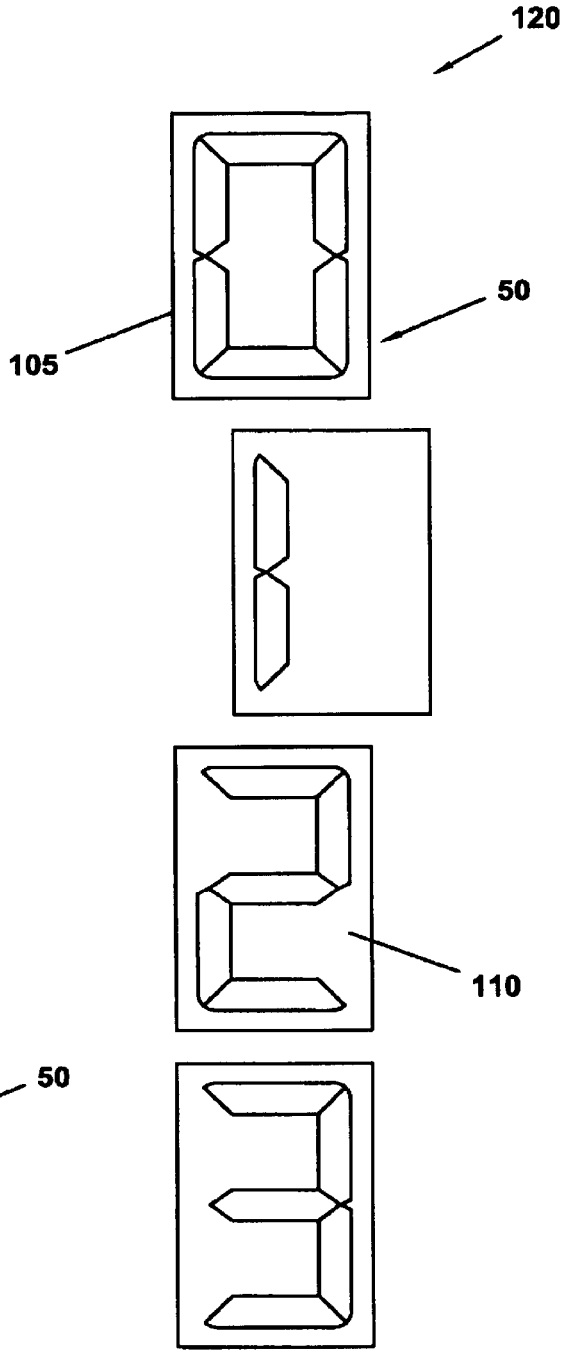
FIG. 4B shows a plurality of the attachable and variable numeric characters of FIG. 2 used to form a vertically oriented multi-digit number, wherein it is illustrated how the variable numeric character used to create a numeral "1" must be offset to obtain proper alignment

As illustrated in FIGS. 4A and 4B, misalignment will also occur when a vertically oriented multi-digit number 120 having a numeral "1" is created from a series of the individual digit eight characters 50. As can be seen in FIG. 4A, if the individual digit eight characters 50 are maintained in an aligned column, the numeral "1" will appear to be off-centered with respect to the other individual numerals of the multi-digit number 120. In this particular example, the numeral "1" is offset to the left because it is formed from the individual vertical section 80, 85 on the left side of the digit eight character 50. However, it should be appreciated that the numeral "1" would similarly be offset to the right should the individual vertical section 60, 65 on the right side of the digit eight character 50 be utilized. In order to produce a proper alignment of the numeral "1" with respect to the other individual numerals of the multi-digit number 120, it is necessary to shift the position of the digit eight character 50 used to create the numeral "1" to the right or left. Thus, once again, proper alignment of the numeral "1" will require that the installer of the digit eight characters 50 approximate the necessary position of the digit eight character used to create the numeral "1". Consequently, as in the previous example, the result is likely a misaligned multi-digit number and the expenditure of additional time by the installer.

Figure 5A:
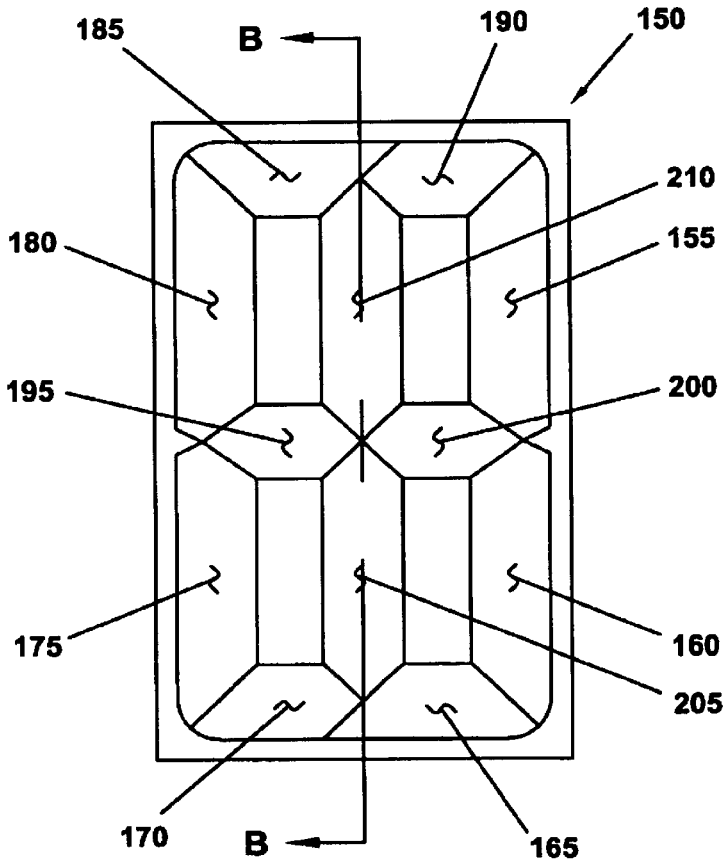
FIG. 5A depicts one embodiment of an attachable and variable digit twelve numeric character of the present invention.

The digit twelve variable numeric character (digit twelve character) 150 of the present invention shown in FIG. 5A overcomes the above-described deficiencies. As can be seen, this embodiment of the digit twelve character 150 is pre-cut into twelve individual sections 155–210. Alternatively, the digit twelve character could be provided in a form that must be cut in order to produce the desired individual numerals. In the embodiment shown in FIG. 5A, particular sections of the digit twelve character 150 may be removed therefrom to create the desired individual numeral. For example, in order to create a numeral "6", individual sections 155, 205 and 210 would be removed.

Preferably, the digit twelve character 150 is provided for use disposed between two sheets of material. As illustrated more clearly in FIG. 5B, there is preferably a backing sheet 210 and a cover sheet 215 located on back surface 220 and front surface 225 of the digit twelve character, respectively. Preferably, each of the backing sheet 210 and the cover sheet 215 are slightly larger than the outer dimensions of the digit twelve character 150. Each of backing sheet 210 and the cover sheet 215 may be constructed from a variety of materials. Typically, the backing sheet 210 is constructed of paper material that is coated to allow its release from the digit twelve character 150. The cover sheet 215 may be of similar composition, or may be comprised of a plastic or other thin material. Preferably, the material comprising the cover sheet 215 is transparent or translucent, such that the digit twelve character 150 is distinguishable therethrough.

Figure 5B:
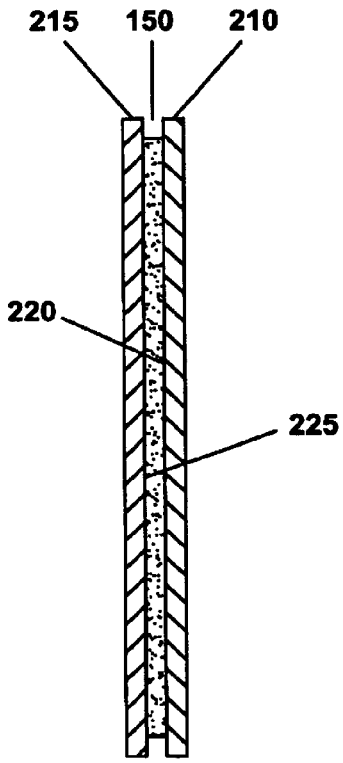
FIG. 5B is a side sectional-view illustrating the variable digit twelve numeric character of FIG. 5A disposed between a backing sheet and cover sheet.

In the embodiment of the digit twelve character 150 depicted in FIGS. 5A and 5B, the back surface 220 of the digit twelve character may be provided with an adhesive or magnetic attachment material. In this manner, the digit twelve character 150 may be affixed to a variety of mounting surfaces. As mentioned above, it is preferable that both the backing sheet 210 and cover sheet 215 be coated or otherwise constructed to allow their separation from the digit twelve character 150. Thus, when creating an individual numeral, the backing sheet 210 may be peeled away, and the necessary individual sections may then be removed from the digit twelve character 150 that is releasably affixed to the cover sheet 215. Once the desired numeral has been created, the cover sheet 215 may be used to locate and affix the numeral to a mounting surface. Once the numeral has been adhered to the mounting surface, the cover sheet 215 may be removed therefrom. Alternatively, the backing sheet 210 may be removed, and the whole of the digit twelve character 150 may be affixed to a mounting surface. Thereafter, the necessary individual sections of the digit twelve character 150 may be peeled or scraped from the mounting surface in order to create the desired numeral.

Figure 6:
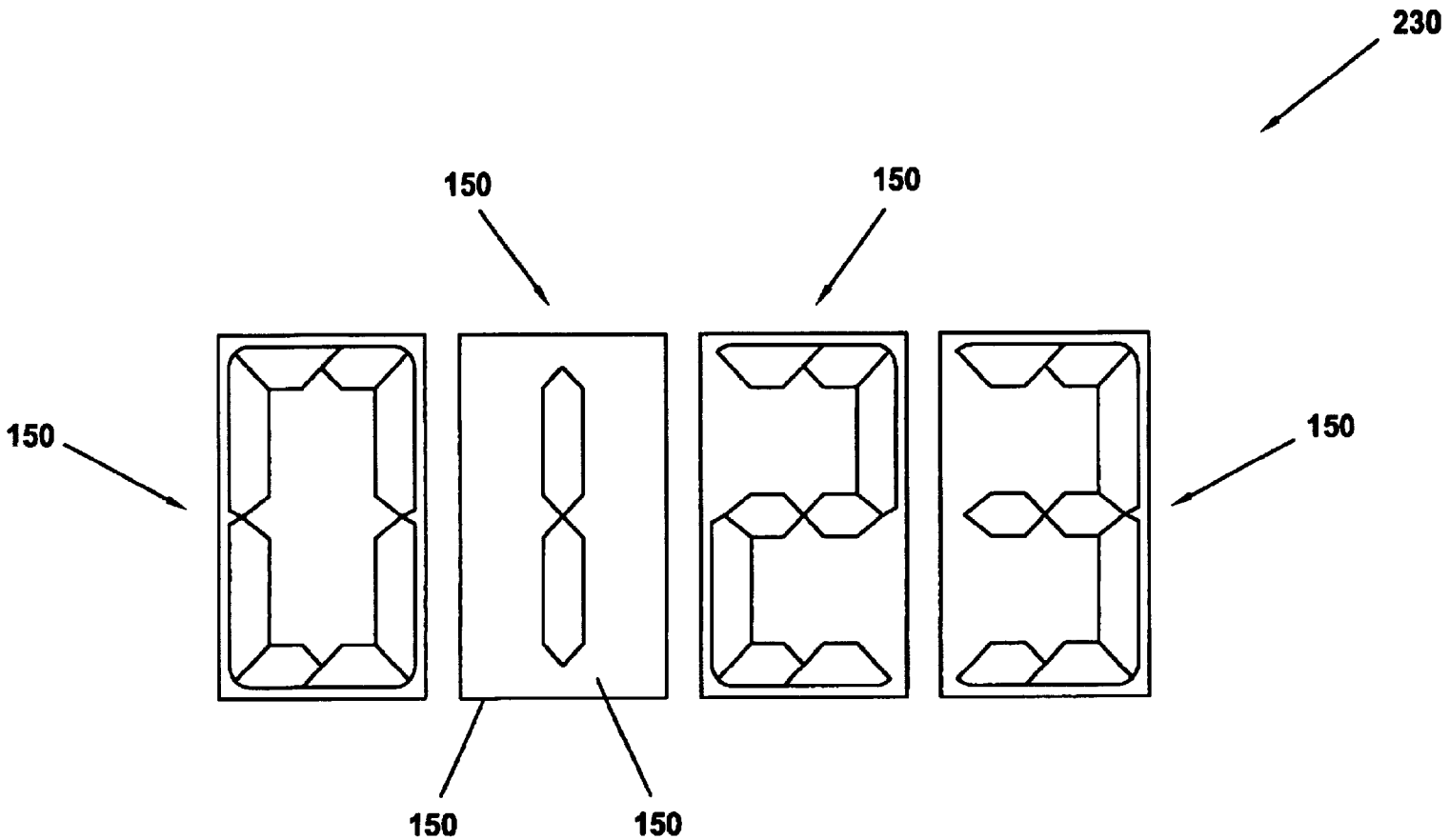
FIG. 6 illustrates a plurality of the attachable and variable digit twelve numeric characters of the present invention used to form a horizontally oriented multi-digit number.

Preferably, the backing sheet 210 and cover sheet 215 encapsulating each digit twelve character 150 are of substantially the same size and shape so that the edges of one or both can be used to help align the individual numerals of a multi-digit number. However, even if this is not the case, the edges of the digit twelve characters 150 themselves can be used to obtain proper alignment. FIG. 6 illustrates how a horizontally oriented multi-digit number 230 can be created by employing a plurality of the digit twelve characters 150 of the present invention. For purposes of comparison, the multi-digit number 230 of FIG. 6 is selected to be the same as the multi-digit number of FIGS. 3A and 3B—specifically, the number "0123". As can be observed from FIG. 6, a horizontally oriented multi-digit number 230 including a numeral "1", can be created from digit twelve characters 150 of the present invention without any of the alignment problems associated with the known digit eight characters 10, 50. Because the digit twelve character 150 of the present invention includes a centered vertical leg, consisting of individual sections 205 and 210, a properly spaced numeral "1" may be created between other individual numerals without requiring the numeral "1" or accompanying cover sheet 215 to be deliberately offset. Likewise, gaps between the edges of the cover sheets 215 may be uniformly maintained without the concern that the numeral "1" will thereby be offset with respect to the numerals that flank it. In order to obtain a uniform spacing, it is also possible to place the individual numerals with the edges of the cover sheets 215 abutting one another. Consequently, there is no chance for the accidental adherence of two adjacent numerals, and the likelihood of misalignment is greatly reduced or even eliminated.

Figure 7:
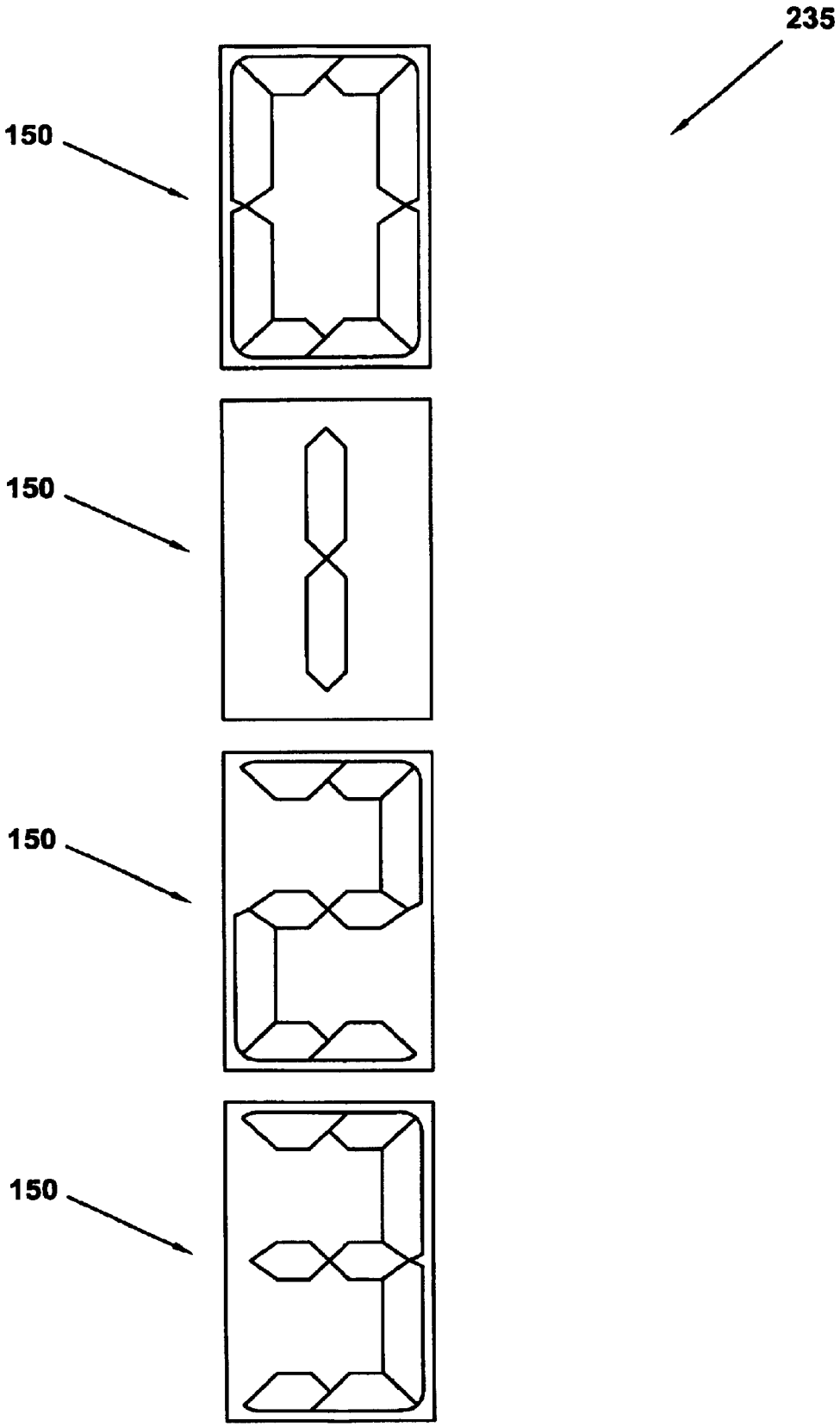
FIG. 7 shows a plurality of the attachable and variable digit twelve numeric characters of the present invention used to form a vertically oriented multi-digit number.

Similarly, FIG. 7 illustrates how a vertically oriented multi-digit number 235 can be created using multiple digit twelve characters 150 of the present invention. For purposes of comparison, the multi-digit number 230 of FIG. 7 is selected to be the same as the multi-digit number of FIGS. 4A and 4B—specifically, the number "0123". As can be observed from FIG. 7, a vertically oriented multi-digit number 235 including a numeral "1", can be created from digit twelve characters 150 of the present invention without any of the alignment problems associated with the known digit eight characters. Because the digit twelve character 150 of the present invention includes a centered vertical leg, consisting of individual sections 205 and 210, a properly spaced numeral "1" may be created between other individual numerals without requiring the numeral or accompanying cover sheet 215 to be deliberately offset. For example, the second through fourth numerals, "1–3" may simply be aligned directly underneath the first numeral, "0". If desired, one or two vertical lines may be drawn to which the edge, or edges, of the cover sheets 215 may be aligned. It is also possible to obtain proper horizontal alignment by placing the appropriate horizontal edge of one cover sheet 215 in abutment with the appropriate edge of the coversheet 215 of the preceding numeral. As shown in FIG. 7, the vertical leg formed by individual sections 205 and 210 provides for proper alignment of the numeral "1", without requiring a deliberate offset thereof. Thus, there is no chance for the accidental adherence of two adjacent numerals, and the likelihood of misalignment is greatly reduced or even eliminated.

Thus, as can be observed from the foregoing description and comparison, the digit twelve character of the present invention allows for the creation of multi-digit numbers including a numeral "1", wherein proper spacing between all of the numerals occurs without any special installation procedures. Particular description has been afforded to a pre-cut digit twelve character, however, it should be realized that the same problems are solved when using a cuttable digit twelve character. Therefore, while certain embodiments of the present invention are described in detail above, the scope of the invention is not to be considered limited by such disclosure, and modifications are possible without departing from the spirit of the invention as evidenced by the following claims:

What is claimed:

1. A variable and attachable numeric character having less than sixteen segments, said character comprising:

a substantially hollow rectangular figure having a perimeter formed by corresponding pairs of substantially parallel horizontal and vertical segments;

a substantially horizontal bisecting segment dividing said hollow rectangular figure into upper and lower portions of substantially equal area;

a substantially vertical bisecting segment extending between said pairs of substantially parallel horizontal segments of said substantially hollow rectangular figure, and dividing said substantially hollow rectangular figure into left and right portions of substantially equal area; and an attachment means affixed to a back surface of each of said segments;

wherein any numeral from zero through nine can be produced by removing one or more particular individual segments of said variable and attachable numeric character; and wherein, when using a plurality of substantially equally spaced variable and attachable numeric characters to create a row or columnar-oriented multi-digit number, removal of all but said substantially vertical bisecting segment produces a numeral one whose spacing from one or more adjacent numerals of said multi-digit number is substantially the same as the spacing between the other numerals of said multi-digit number.

2. The variable and attachable numeric character of claim 1, wherein said attachment means comprises an adhesive material for allowing affixation to a mounting surface.

3. The variable and attachable numeric character of claim 1, wherein said attachment means comprises a magnetic material for allowing affixation to a mounting surface.

4. The variable numeric character of claim 1, wherein said variable and attachable numeric character is disposed between a removable cover sheet and a removable backing sheet that abut a front surface and a back surface of said variable and attachable numeric character, respectively.

5. The variable and attachable numeric character of claim 1, wherein said numerals are formed by cutting away certain combinations of said substantially parallel horizontal and vertical legs, said substantially horizontal bisecting leg, and said substantially vertical bisecting leg.

6. The variable and attachable numeric character of claim 1, wherein said legs are pre-cut into specific segments to allow for their selected removal and the subsequent formation of an individual numeral.

7. A twelve segment individual attachable and variable numeric character, consisting of:

a hollow rectangular figure having a perimeter formed by two substantially corresponding pairs of parallel horizontal segments, and two substantially corresponding pairs of parallel vertical segments;

a pair of horizontal bisecting segment of substantially equal length dividing said hollow rectangular figure into upper and lower portions of substantially equal area;

a pair of vertical bisecting segments of substantially equal length, dividing said hollow rectangular figure into left and right portions of substantially equal area; and attachment means located on a back surface of each of said legs;

wherein any numeral from zero through nine can be produced by removing one or more particular individual segments of said attachable and variable numeric character; and wherein, during the creation of a row or columnar-oriented multi-digit number from a plurality of attachable and variable numeric characters having substantially equal spacing between the perimeters thereof, said pair of vertical bisecting segments produces a numeral one that is substantially equally spaced from one or more adjacent numerals of said multi-digit number.

8. The attachable and variable numeric character of claim 7, wherein said attachment means is an adhesive.

9. The attachable and variable numeric character of claim 7, wherein said attachment means is a magnetic material.

10. The attachable and variable numeric character of claim 7, wherein said attachable and variable numeric character is disposed between a removable backing sheet abutting said back surface and a removable cover sheet abutting a front surface of said attachable and variable numeric character.

11. The attachable and variable numeric character of claim 10, wherein said certain of said legs are removed by cutting.

12. The attachable and variable numeric character of claim 7, wherein said legs are pre-cut into a plurality of segments, to allow for the removal thereof during the creation of individual numerals therefrom.

13. A method of forming a row or columnar-oriented multi-digit number from a plurality of individual, like variable numeric characters, wherein the individual numerals of said multi-digit number, including the numeral one, will be substantially evenly spaced and aligned with respect to the other individual numerals of said multi-digit number, comprising:

providing multiple individual twelve-segment variable numeric characters, each consisting of a hollow rectangular figure having a perimeter formed by two corresponding pairs of substantially parallel horizontal segments and two corresponding pairs of substantially vertical segments, a pair of horizontal bisecting segments of substantially equal length dividing said hollow rectangular figure into upper and lower portions of substantially equal area, and a pair of vertical bisecting segments of substantially equal length dividing said hollow rectangular figure into left and right portions of substantially equal area, each of said segments having a front surface and a back surface;

disposing each variable numeric character between a removable backing sheet and cover sheet of substantially consistent size, said backing sheet contacting said back surface of said variable numeric character, and said cover sheet contacting said front surface of said variable numeric character;

providing an attachment means on said back surface of said variable numeric character;

removing said backing sheet;

selectively removing certain of said segments of each variable numeric character from its respective cover sheet to form a desired numeral from zero to nine, the numeral one being produced by removing all but said pair of vertical bisecting segments;

locating each individual numeral on a mounting surface with said back surface in contact therewith, such that said cover sheets thereof are substantially aligned and substantially evenly spaced; and removing each cover sheet.

14. The method of claim 13, wherein said attachment means is an adhesive.

15. The method of claim 13, wherein said attachment means is magnetic.

16. The method of claim 13, wherein said multi-digit number includes at least one numeral one.

17. The method of claim 13, wherein said cover sheets are transparent or translucent.

18. The method of claim 13, further comprising providing guide marks on said cover sheet and/or said backing sheet to aid in alignment of said individual numerals of said multi-digit number.

19. The method of claim 13, wherein said multi-digit number is horizontally oriented.

20. The method of claim 13, wherein said multi-digit number is vertically oriented.

* * * * *

UNITED STATES PATENT AND TRADEMARK OFFICE

CERTIFICATE OF CORRECTION

PATENT NO. : 6,760,987 B1
DATED : July 13, 2004
INVENTOR(S) : Mulkey

It is certified that error appears in the above-identified patent and that said Letters Patent is hereby corrected as shown below:

Column 5,
Line 58, please delete "to shift the portion" and insert -- to shift the position --

Signed and Sealed this

Thirty-first Day of August, 2004

JON W. DUDAS
*Director of the United States Patent and Trademark Office*